US011566489B2

(12) United States Patent
Patil et al.

(10) Patent No.: US 11,566,489 B2
(45) Date of Patent: Jan. 31, 2023

(54) STAGE CEMENTER PACKER

(71) Applicant: Halliburton Energy Services, Inc., Houston, TX (US)

(72) Inventors: Ishwar Dilip Patil, Conroe, TX (US); Lonnie Carl Helms, Humble, TX (US); Avinash Gopal Dharne, Houston, TX (US); Frank Vinicio Acosta, Spring, TX (US); Priyanshkumar Prashantkumar Desai, Stafford, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 36 days.

(21) Appl. No.: 17/243,828

(22) Filed: Apr. 29, 2021

(65) Prior Publication Data

US 2022/0349272 A1 Nov. 3, 2022

(51) Int. Cl.

| | |
|---|---|
| ***E21B 33/14*** | (2006.01) |
| ***E21B 21/10*** | (2006.01) |
| ***E21B 33/128*** | (2006.01) |
| ***E21B 23/04*** | (2006.01) |

(52) U.S. Cl.

CPC ..... *E21B 33/146* (2013.01); *E21B 21/10* (2013.01); *E21B 23/04* (2013.01); *E21B 33/1285* (2013.01)

(58) Field of Classification Search

CPC .... E21B 33/146; E21B 33/1285; E21B 21/10; E21B 23/04; E21B 33/14

See application file for complete search history.

(56) References Cited

U.S. PATENT DOCUMENTS

| | | | |
|---|---|---|---|
| 3,789,926 | A | 2/1974 | Henley et al. |
| 3,948,322 | A | 4/1976 | Baker |
| 4,487,263 | A | 12/1984 | Jani |
| 4,674,569 | A | 6/1987 | Revils et al. |
| 5,024,273 | A | 6/1991 | Coone et al. |
| 5,279,370 | A | 1/1994 | Brandell et al. |
| 5,411,095 | A | 5/1995 | Ehlinger et al. |
| 5,443,124 | A | 8/1995 | Wood et al. |
| 5,647,434 | A | 7/1997 | Sullaway et al. |
| 5,765,641 | A | 6/1998 | Shy et al. |
| 6,026,903 | A | 2/2000 | Shy et al. |
| 6,244,342 | B1 | 6/2001 | Sullaway et al. |
| 6,425,442 | B1 | 7/2002 | Latiolais, Jr. et al. |
| 6,796,377 | B2 | 9/2004 | Butterfield, Jr. et al. |
| 6,802,373 | B2 | 10/2004 | Dillenbeck et al. |

(Continued)

FOREIGN PATENT DOCUMENTS

EP 1262629 A1 12/2002

OTHER PUBLICATIONS

International Search Report and Written Opinion dated Apr. 5, 2021, issued in PCT Application No. PCT/US2020/053694.

(Continued)

*Primary Examiner* — Taras P Bemko

(74) *Attorney, Agent, or Firm* — McAfee & Taft

(57) ABSTRACT

A stage cementing tool has a mandrel defining a central flow passage and a plurality of fully open cement flow ports. A packer disposed about the mandrel is movable from an unset to a set position. An opening sleeve is movable in the mandrel from a closed position to an open position in which the flow ports are exposed to allow flow therethrough. The opening sleeve is operable to move the setting sleeve to set the packer against the wellbore as it moves in the mandrel from the closed to the open position.

18 Claims, 12 Drawing Sheets

(56) References Cited

U.S. PATENT DOCUMENTS

| | | | |
|---|---|---|---|
| 7,237,611 | B2 | 7/2007 | Vincent et al. |
| 7,857,052 | B2 | 12/2010 | Giroux et al. |
| 7,866,402 | B2 | 1/2011 | Williamson, Jr. |
| 8,215,404 | B2 | 7/2012 | Makowiecki et al. |
| 8,616,276 | B2 | 12/2013 | Tips et al. |
| 8,646,537 | B2 | 2/2014 | Tips et al. |
| 8,720,561 | B2 | 5/2014 | Zhou |
| 9,010,442 | B2 | 4/2015 | Streich et al. |
| 9,121,255 | B2 | 9/2015 | Themig et al. |
| 9,291,007 | B2 | 3/2016 | Darbe et al. |
| 9,441,440 | B2 | 9/2016 | Hofman et al. |
| 9,441,446 | B2 | 9/2016 | Fripp et al. |
| 9,506,324 | B2 | 11/2016 | Kyle et al. |
| 9,587,486 | B2 | 3/2017 | Walton et al. |
| 9,816,351 | B2 | 11/2017 | Lirette et al. |
| 9,920,620 | B2 | 3/2018 | Murphree et al. |
| 10,024,150 | B2 | 7/2018 | Andreychuk et al. |
| 10,316,619 | B2 | 6/2019 | de Oliveira et al. |
| 10,358,914 | B2 | 7/2019 | Roberson et al. |
| 10,557,329 | B2 | 2/2020 | Gao et al. |
| 11,280,157 | B2 | 3/2022 | Acosta et al. |
| 11,293,253 | B2 | 4/2022 | Santoso et al. |
| 2006/0207765 | A1 | 9/2006 | Hofman |
| 2007/0261850 | A1 | 11/2007 | Giroux et al. |
| 2008/0251253 | A1 | 10/2008 | Lumbye |
| 2009/0071655 | A1 | 3/2009 | Fay |
| 2009/0151960 | A1 | 6/2009 | Rogers et al. |
| 2010/0051276 | A1 | 3/2010 | Rogers et al. |
| 2010/0163253 | A1 | 7/2010 | Caldwell et al. |
| 2013/0048290 | A1 | 2/2013 | Howell et al. |
| 2013/0233570 | A1 | 9/2013 | Acosta et al. |
| 2013/0233572 | A1 | 9/2013 | Helms et al. |
| 2015/0027706 | A1 | 1/2015 | Symms |
| 2015/0184489 | A1 | 7/2015 | Resweber |
| 2017/0145784 | A1 | 5/2017 | Zhou |
| 2019/0017366 | A1 | 1/2019 | Alaas et al. |
| 2019/0249549 | A1 | 8/2019 | Fripp et al. |
| 2020/0270967 | A1 | 8/2020 | Fong et al. |
| 2021/0010345 | A1 | 1/2021 | Acosta et al. |

OTHER PUBLICATIONS

Halliburton Brochure, "Cementing ES II Stage Cementer," Feb. 2009.

Halliburton Brochure, "Fidelis Stage Cementer," Sep. 2013.

Halliburton Catalog titled "Casing Equipment" (2015), entire catalog.

International Search Report and Written Opinion dated Jun. 20, 2022, issued in PCT Application No. PCT/US2022/020696.

STAGE CEMENTER PACKER

BACKGROUND

When completing a subterranean well, casing is typically inserted into the wellbore and secured in place by injecting cement within the casing. The cement is forced through a lower end of the casing and into an annulus between the casing and wellbore wall. A displacement fluid is pumped into the casing above a plug to urge the plug downward through the casing to extrude the cement from the casing outlet and back up into the annulus. In some instances, it is impossible or impractical to cement the entire well.

To overcome the problems of a single stage cement process, the casing string is cemented in sections, which is known as a staging process. Staging involves placing cement staging tools integral within the casing string; the staging tools allow cement to flow downward therethrough to a lower section of the casing string during primary or first stage cementing operations. When the portion of the casing string below the particular staging tool is cemented to the well, the staging tool will divert cement into the surrounding annulus where the cement can flow upwards in the annulus.

BRIEF DESCRIPTION OF THE DRAWINGS

FIG. 6 is a cross section of the cementing tool after drillout of the plugs.

FIG. 9 is a cross section of the cementing tool of FIG. 8 in a set position.

DESCRIPTION OF AN EMBODIMENT

Figure 1:
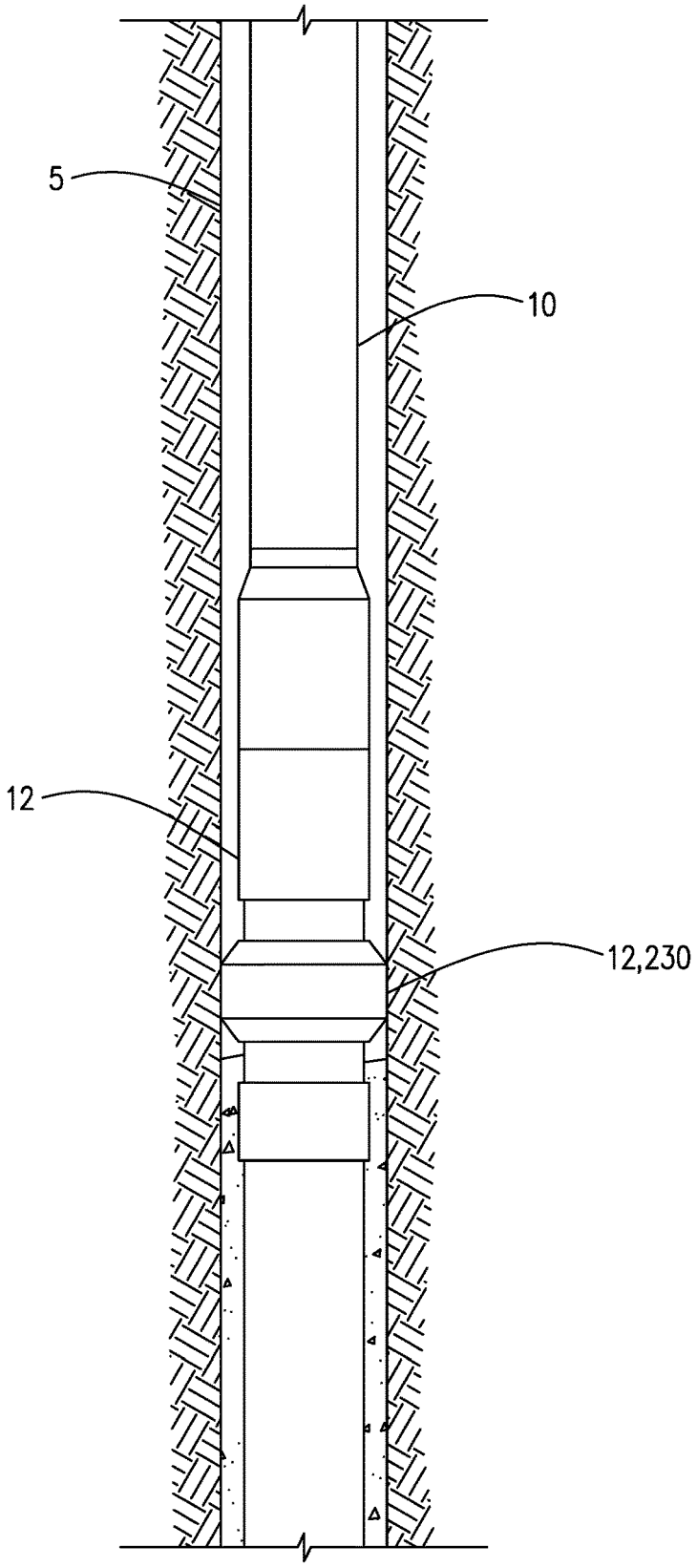
FIG. 1 is a schematic showing a stage cementing tool in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis.

Figure 2:
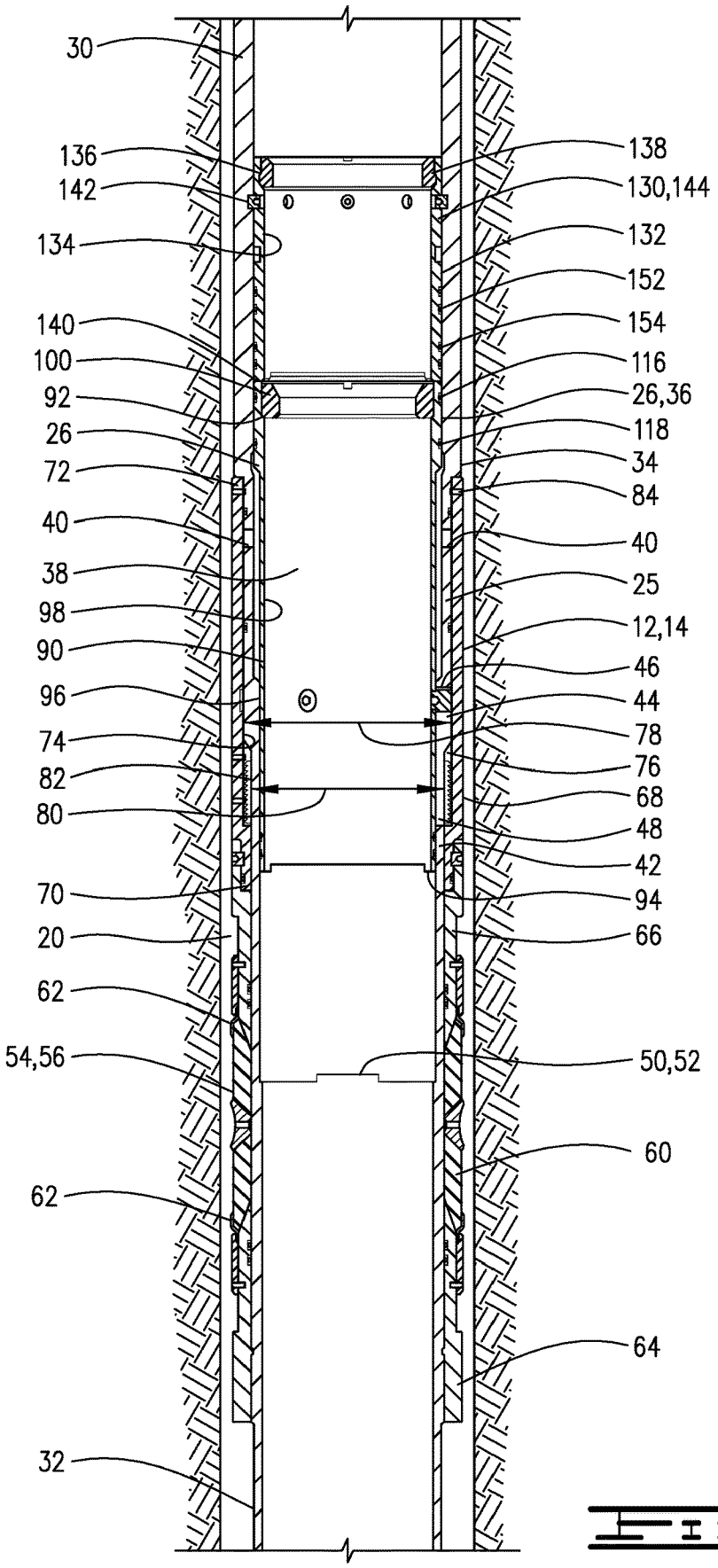
FIG. 2 is a cross section of the cementing tool in a run-in position.
Figure 3:
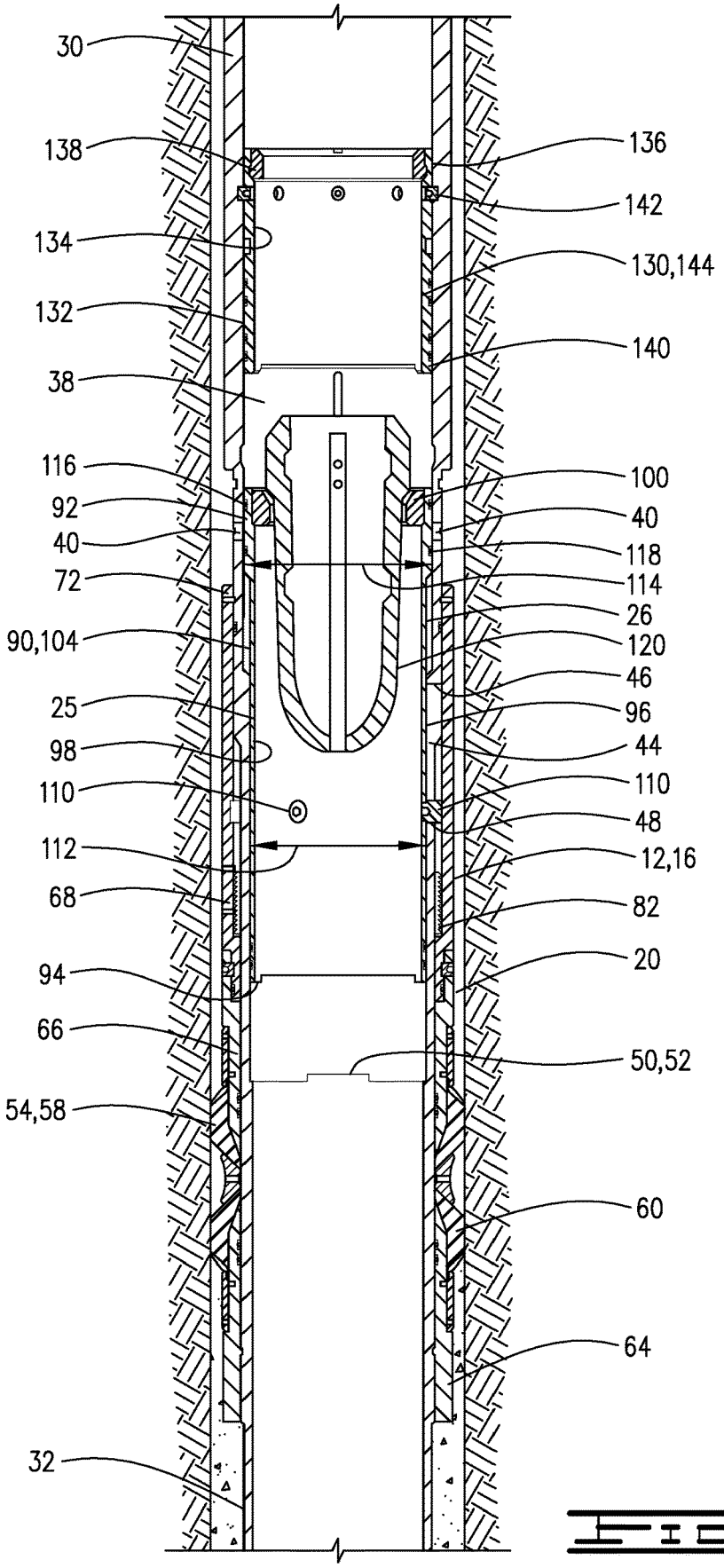
FIG. 3 is a cross section of the tool in a set position.

FIG. 1 shows a stage cementing tool 12 lowered into a wellbore 5 on casing 10. As will be described in more detail herein, stage cementing tool 12 is lowered into the wellbore in a run-in position 14 as shown in FIG. 2, a set or intermediate position 16 as shown in FIG. 3, and an open or cementing position 18 shown in FIG. 4. Stage cementing tool 12 has a completed position 19 shown in FIG. 5. Stage cementing tool 12 and wellbore 5 define an annulus 20 therebetween. In one embodiment stage cementing tool 12 comprises a mandrel 25 with upper end 30, lower end 32, outer surface 34 and inner surface 36. Mandrel 25 defines a central flow passage 38 and has a plurality of cement flow ports 40 defined through a wall 42 thereof. Cement flow ports 40 are fully open cement flow ports. In other words, there is no rupture disk or other barrier in the cement flow port 40 that will prevent flow therethrough. A plurality of longitudinal slots 44 with upper end 46 and lower end 48 are also defined in wall 42 of mandrel 25.

Mandrel 25 in the embodiment shown in FIGS. 2-7 is a single tubular, or tool body that includes both a packer 54 and cementing valve 26 thereon. Mandrel 25 defines a shoulder 50 with anti-rotation profile 52 machined on an inner surface thereof which will as explained herein prevent rotation of sleeves in the mandrel during a drill-out operation.

Packer 54 is movable from an unset position 56 to a set position 58 and is disposed about mandrel 25. In the set position 58, which is the set position 16 of stage cementing tool 12, packer 54 will seal against wellbore 5. Packer 54 may comprise a compression set packer with an element or a plurality of elements 60 and packer shoes 62 at upper and lower ends thereof. A fixed wedge 64 is mounted to mandrel 25 below packer elements 60. A setting wedge 66 is disposed about mandrel 25 above packer element 60. Cementing valve 26 comprises a setting sleeve 68 slidably mounted to mandrel 25 on the outer surface thereof. Setting sleeve 68 has lower end 70, upper end 72 and inner surface 74. Lower end 70 is connected to setting wedge 66. Setting wedge 66 will move packer 54 to the set position upon movement of setting sleeve 68 as described herein. Although in the described embodiment setting wedge 66 and setting sleeve 68 are separate pieces it is understood that they may be formed as a single integral piece.

Mandrel 25 is a stepped mandrel that has a plurality of outer diameters including a first outer diameter 78 and a second outer diameter 80. An annular space 76 is defined by and between second outer diameter 80 and inner surface 74 of setting sleeve 68. A body lock ring 82 is connected to setting sleeve 68 in annular space 76. Body lock ring 82 is connected to and movable with setting sleeve 68. The outer surface of mandrel 25 will have teeth thereon that will engage body lock ring 82 to prevent upward movement, but to allow downward movement of setting sleeve 68. A shear pin 84 or other connecting means may connect setting sleeve 68 to mandrel 25.

Figure 4:
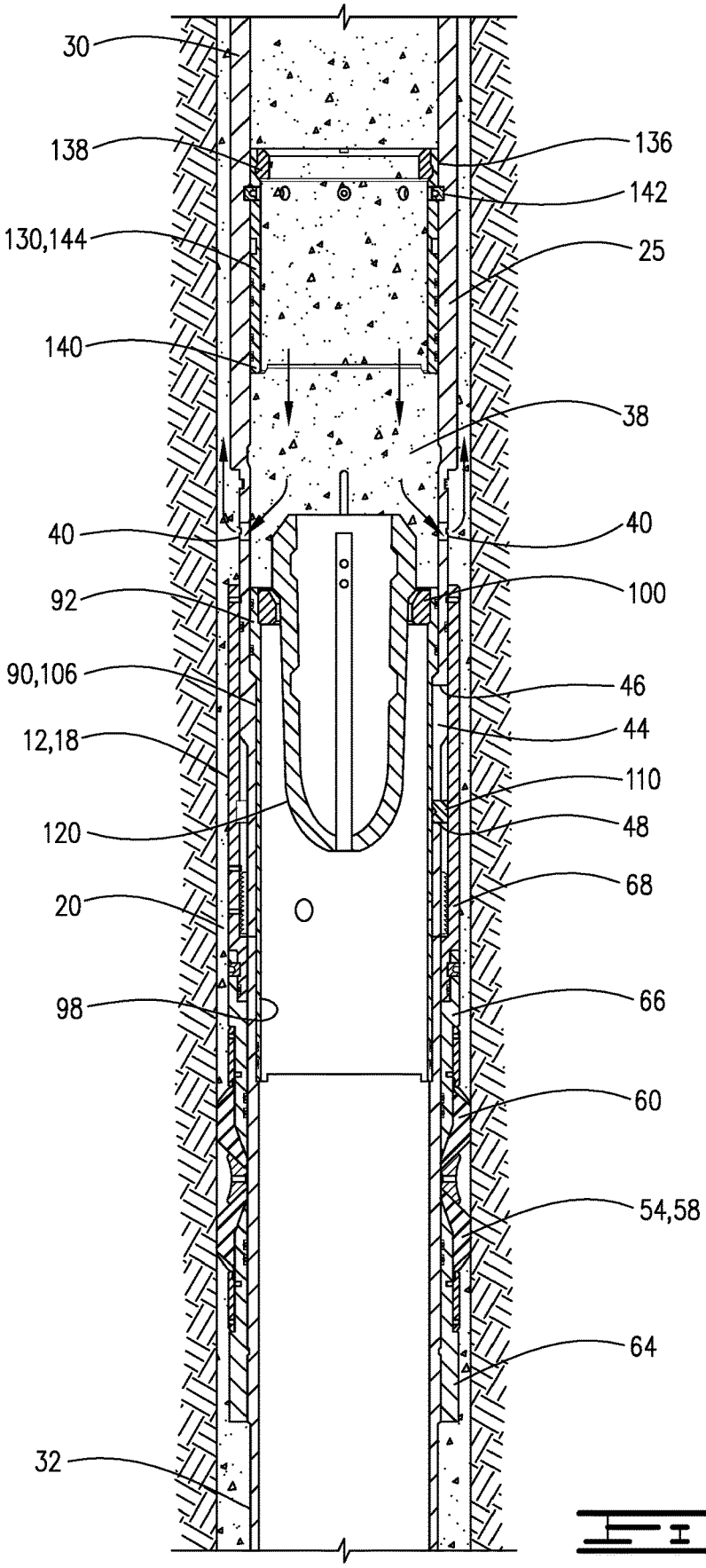
FIG. 4 is a cross section of the tool in a cementing position.
Figure 5:
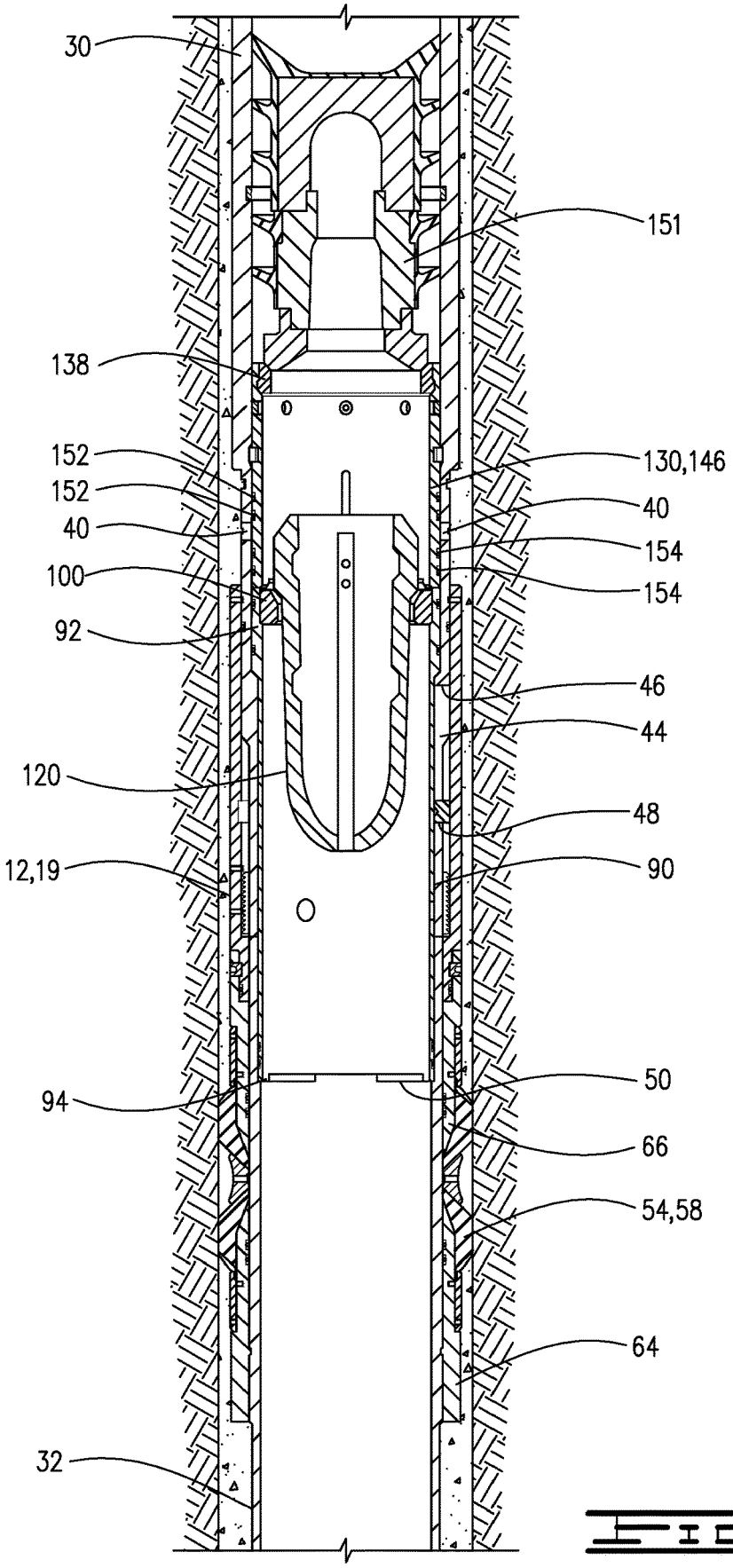
FIG. 5 is a cross section of the tool in a closed or completed position.
Figure 5:
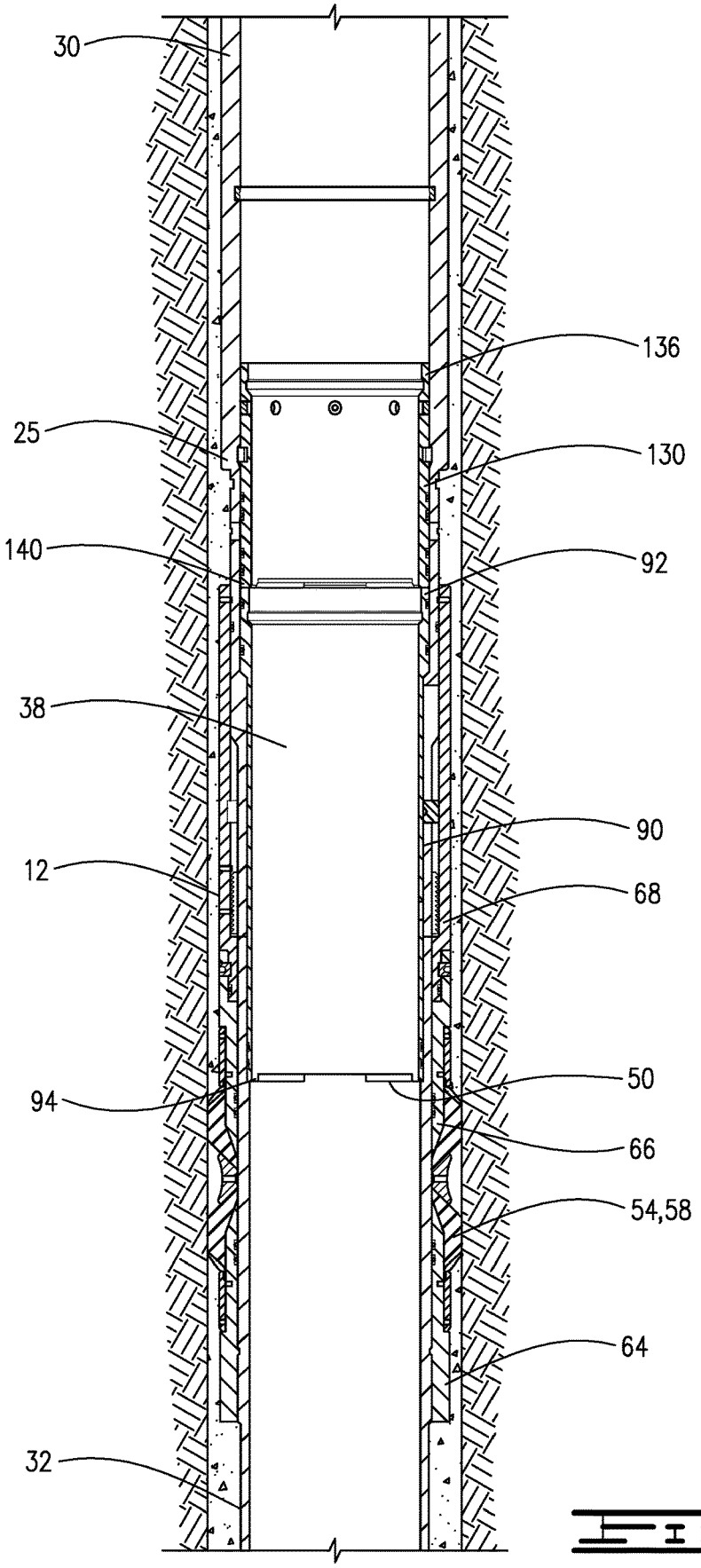
Figure 7:
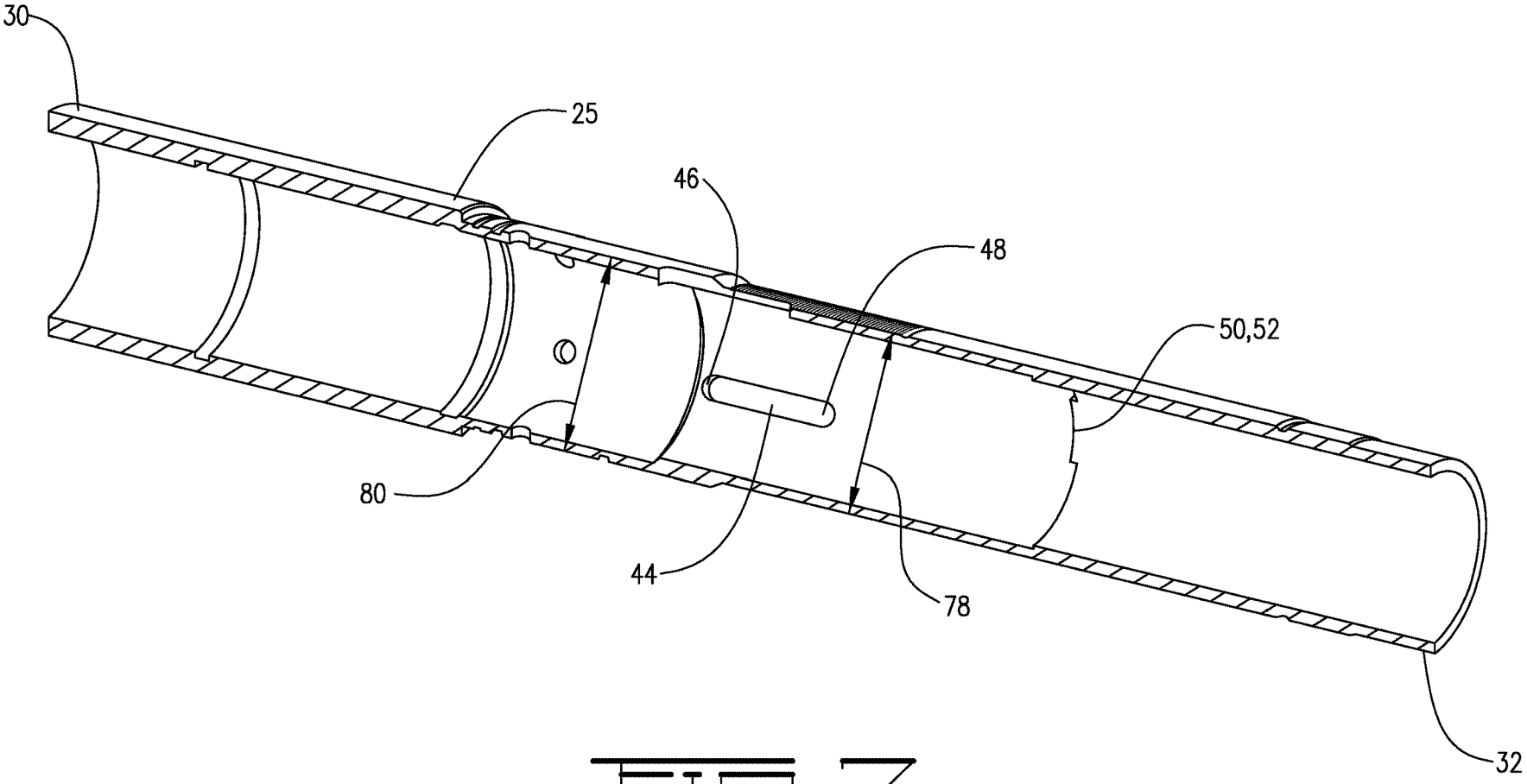
FIG. 7 shows a cutaway section view of the mandrel.
Figure 8:
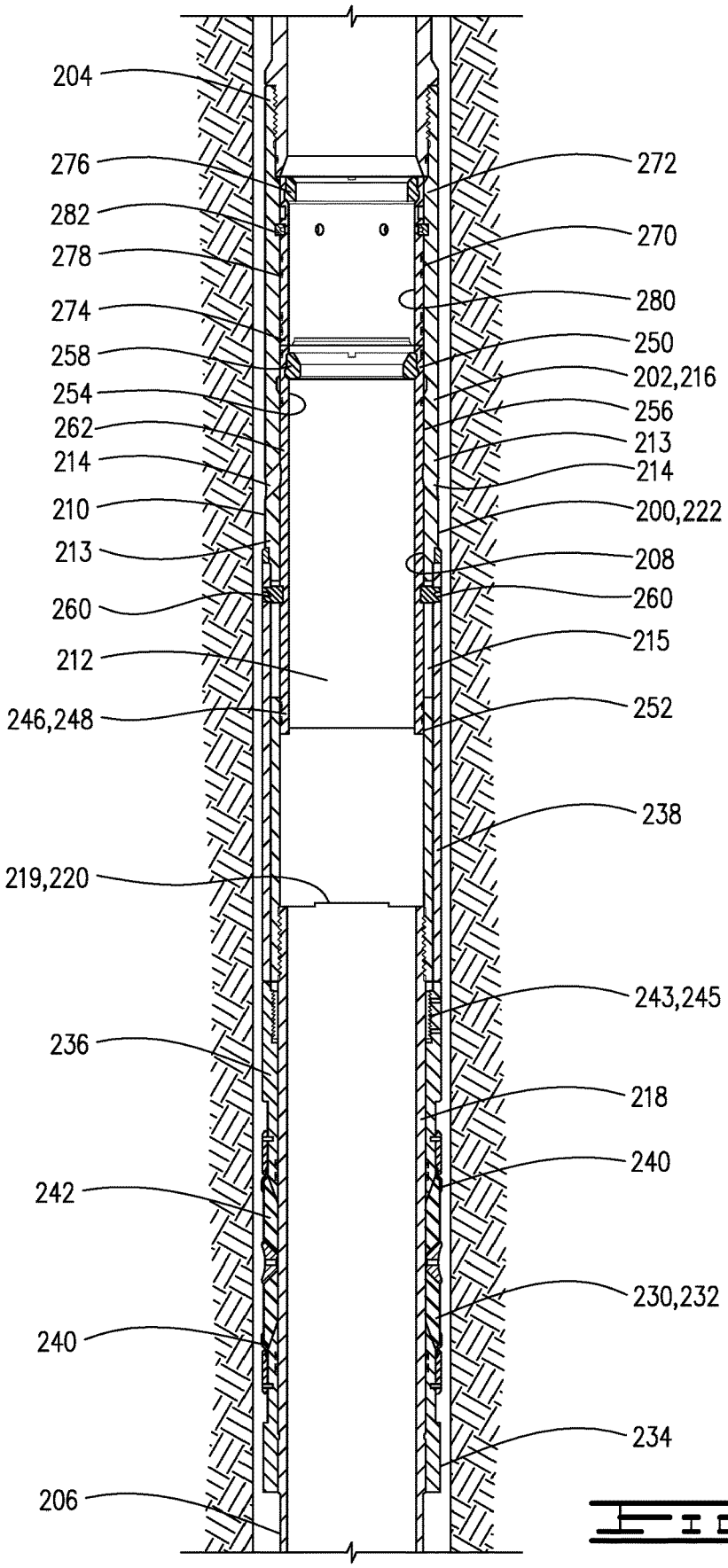
FIG. 8 is a cross section of an additional embodiment of a stage cementing tool in a run-in position.
Figure 3:
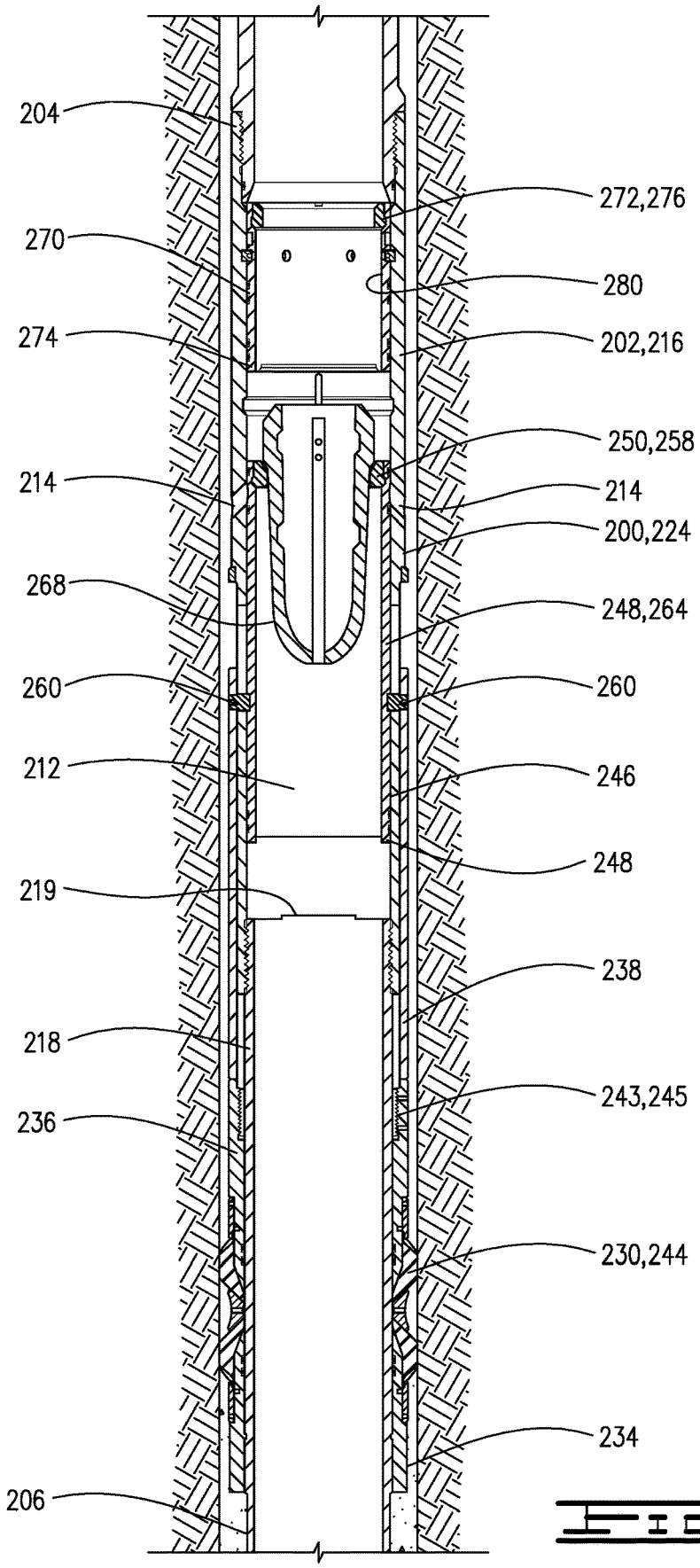

Cementing valve 26 is shown in a run-in, closed position in FIG. 2 which is the closed position of the stage cementing tool 12, and is movable to an open position, or cementing position of FIG. 4 which is the cementing position 18 of the stage cementing tool 12. In an intermediate position between the closed and the cementing positions, cementing valve 26 moves packer 54 to the set position. Cementing valve 26 comprises setting sleeve 68 and an opening sleeve 90 slidably disposed in mandrel 25. Opening sleeve 90 has upper end 92, lower end 94, outer surface 96 and an inner surface 98. An opening seat 100, which may be a separate piece connected to opening sleeve 90 or may be integrally formed therewith is positioned at upper end 92 of opening sleeve 90. FIG. 3 shows cement valve 26 and opening sleeve 90 at the intermediate position which is the set position of the stage cementing tool 12. FIG. 4 shows the open, or cementing position of the valve 26 and opening sleeve 90. In both of the closed and intermediate positions of the opening sleeve and the stage cementing tool flow from central flow passage 38 into annulus 20 through cement flow ports 40 is blocked by opening sleeve 90. In the closed position cement flow ports 40 are sealingly captured between setting sleeve 68 and opening sleeve 90.

A plurality of drive pins 110 which are breakable drive pins 110 connect opening sleeve 90 with setting sleeve 68. Drive pins 110 extend through longitudinal slots 44 in mandrel 25. Outer surface 96 of opening sleeve 90 defines a first outer diameter 112 and second outer diameter 114. First outer diameter 112 is slidingly and sealingly engaged with inner surface 36 of mandrel 25. Outer surface 96 has seals 116 and 118 that sealingly engage the inner surface 36 of mandrel 25. Seals 116 and 118 are spaced apart such that they straddle cement flow ports 40 in the set position of the opening sleeve 90 to prevent flow from central flow passage 38 therethrough.

Once the prior cementing stage has been completed through casing 10 an opening plug 120 is displaced through casing 10 and will pass through a closing sleeve 130 that is detachably connected to mandrel 25. Opening plug 120 will engage opening seat 100. With the application of pressure after opening plug 120 engages with opening seat 100 shear pin 84 will break and allow valve 26 to move downwardly relative to mandrel 25. Opening sleeve 90 will move downwardly inside mandrel 25 and will cause setting sleeve 68 to move downwardly on the outer surface of mandrel 25. Setting sleeve 68 will urge setting wedge 66 into packer elements 60 to urge the packer elements outwardly into engagement with wellbore 5. This is the set position of the stage cementing tool 12, in which valve 26 is in an intermediate position between the closed and the open positions. Continued application of pressure above opening plug 120 will cause drive pins 110 to shear or break. Once drive pins 110 are broken opening sleeve 90 will move downwardly relative to the mandrel 25 and the setting sleeve 68 to the open position of the opening sleeve 90 and the stage cementing tool 12. The open, or cementing position of the stage cementing tool 12 and the opening sleeve 90 is the position in which the packer 54 is set against the wellbore 5 but the opening sleeve 90 has moved to allow cement to flow from the central flow passage 38 to the annulus 20.

Closing sleeve 130 has an outer surface 132. Closing sleeve 130 sealingly engages the inner surface 36 of mandrel 25. Closing sleeve 130 has an inner surface 134 and an upper end 136 and a lower end 140. A closing seat 138 is defined at upper end 136 and may comprise a separate member that is connected to closing sleeve 130 or may be integrally formed with closing sleeve 130. Closing sleeve 130 is detachably connected to mandrel 25 with shear pins 142. Closing sleeve 130 is movable from a first position 144 to a second position 146. Closing sleeve 130 stays in its first position 144 in the run-in, set and cementing positions of the stage cementing tool 12 and opening sleeve 90. Once the desired amount of cement has been displaced through cement flow ports 40 a closing plug 151 will be displaced into casing 10 behind a trailing edge of the cement. Closing plug 151 will engage closing seat 138 and as pressure is applied thereabove shear pins 142 will break to detach closing sleeve 130 from mandrel 25. Closing sleeve 130 will move downwardly in mandrel 25. Closing sleeve 130 will cover the cement flow ports 40 to prevent flow therethrough. Closing sleeve 130 may include a plurality of seals 152 spaced from a plurality of seals 154. In the second position 146 of the closing sleeve the stage cementing tool 12 is in a completed position of the stage cementing tool 12. In that position seals 152 and 154 may straddle cement flow ports 40.

If desired, lower end 140 of closing sleeve 130 may have an anti-rotation profile thereon to engage an upper end of opening sleeve 90 such that no relative rotation between opening sleeve 90 and closing sleeve 130 will occur during a drill-out process. Likewise, the lower end 94 of opening sleeve 90 may have an anti-rotation profile thereon to engage the anti-rotation profile machined in mandrel 25 to prevent rotation.

The embodiment as described thus comprises a cementing valve 26 and a packer 54 on a single tool body. A single plug, the opening plug 120, may be utilized to move the cementing valve 26 to an open position which opens ports 40 and also moves the packer 54 and the stage cementing tool 12 to the set position. The opening sleeve 90 of the valve 26 moves downwardly which sets the packer 54 and also opens the cement flow ports 40. Utilizing the described embodiment eliminates the use of rupture disks in cement flow ports and allows for the use of fully open cement flow ports. A single plug (opening plug 120) and a single sleeve (opening sleeve 90) are used to set the packer and open communication between the central flow passage 38 and annulus 20 through cement flow ports 40. The opening sleeve 90 sets the packer 54 by moving the setting sleeve 68 downwardly on the outer surface 34 of mandrel 25. Opening sleeve 90 of valve 26 is in an intermediate position between the run-in and open positions when it moves the packer 54 to the set position.

In operation casing 10 is lowered into wellbore 5 until it reaches a desired location in the wellbore. Prior stage cementing is performed in a normal fashion. Once the prior stage cementing has been completed such that the casing 10 below packer 54 has been cemented, opening plug 120 is displaced through casing 5 until it engages opening seat 100. Pressure is increased until cementing valve 26 is detached from mandrel 25 so that it can move downwardly. Cementing valve 26 moves downwardly to an intermediate position to move the packer 54 to the set position in which the packer 54 is set against wellbore 5. Increased pressure will cause drive pins 110 to break and will allow opening sleeve 90 to move downward relative to mandrel 25 and setting sleeve 68. Downward movement of opening sleeve 90 will stop when it engages shoulder 50 defined on inner surface 36 of mandrel 25. Shoulder 50 may have anti-rotation profile 52 to engage an anti-rotation profile on the lower end 94 of opening sleeve 90. Cement valve 26 thus sets packer 54 in an intermediate position between the closed, or run-in and the open, or cementing position.

Once the cement valve 26 is in the open position cement is displaced through cement flow ports 40 into annulus 20. Once an appropriate amount of cement has been displaced into casing 5 closing plug 151 is placed in the casing behind the trailing edge of the cement. Closing plug 151 will engage closing seat 138. Pressure is increased thereabove until shear pins 142 break and closing sleeve 130 moves downwardly until it engages the upper end 92 of opening sleeve 90. Closing sleeve 130 prevents flow through cement flow ports 40 in its second position. If desired, components internal to mandrel 25 such as closing plug 151 and opening plug 120 may be drilled out so that a full open bore is available for the passage of fluids therethrough.

Figure 10:
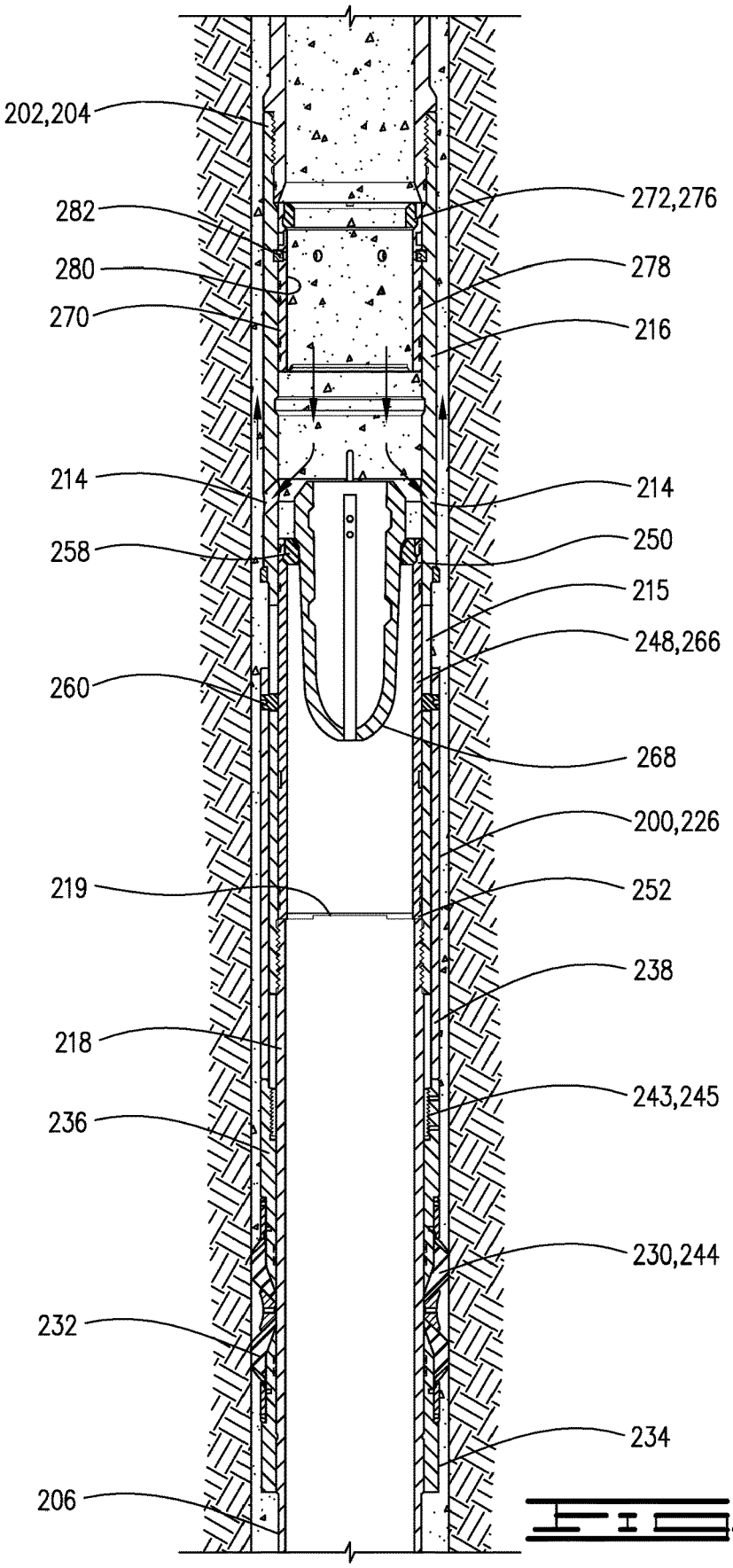
FIG. 10 is a cross section of the cementing tool of FIG. 8 in a cementing position.
Figure 11:
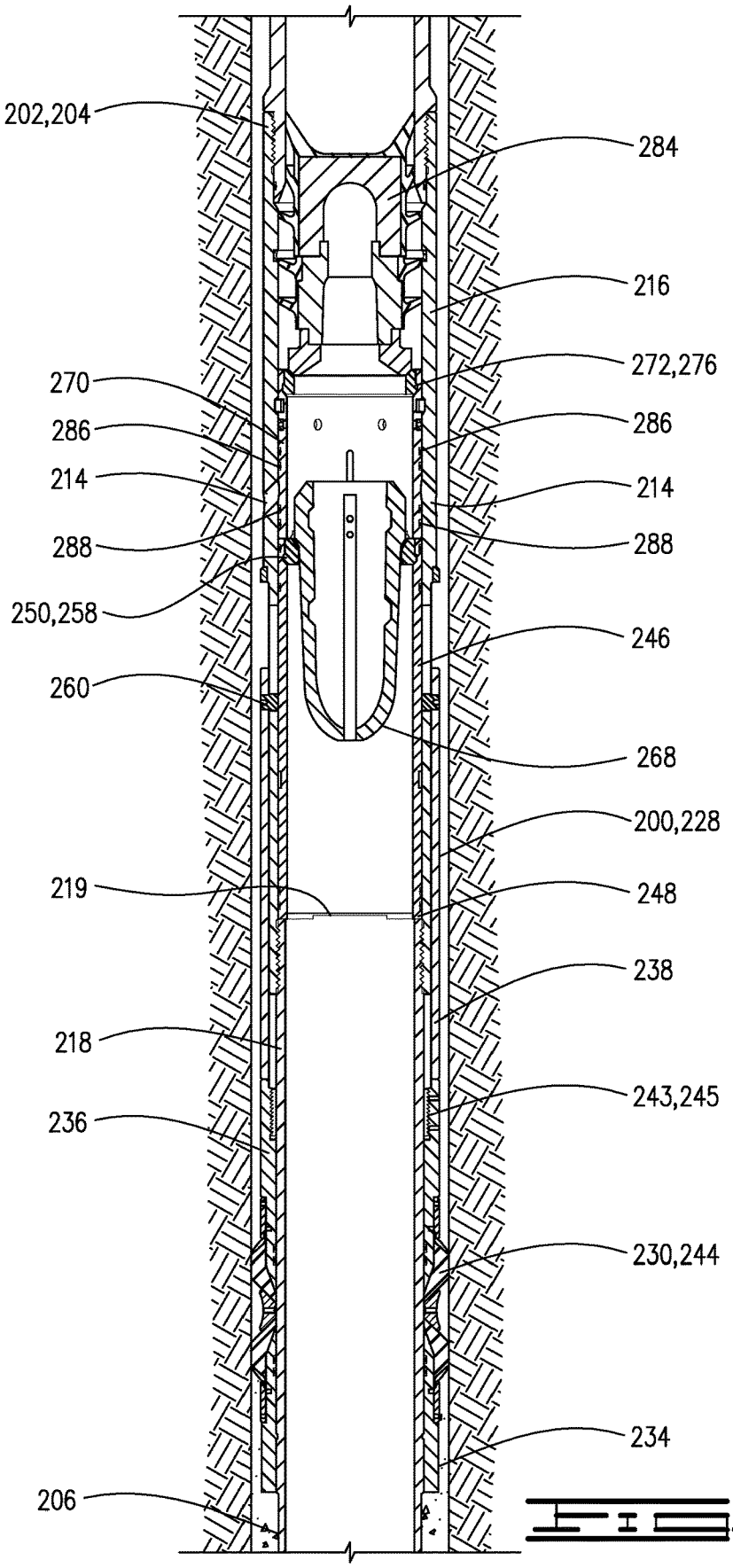
FIG. 11 is a cross section of the cementing tool of FIG. 8 in a closed or completed position.

An additional embodiment of a stage cementing tool 200 is shown in FIGS. 8-12. Stage cementing tool 200 comprises a mandrel 202 with upper end 204, lower end 206, inner surface 208 and an outer surface 210. Mandrel 202 defines a central flow passage 212 therethrough and a plurality of cement flow ports 214 in a wall 213 thereof. A plurality of longitudinal slots 215 are defined in mandrel wall 213. Mandrel 202 may comprise a two-piece mandrel with upper mandrel 216 and lower mandrel 218 connected thereto. An upper end 219 of lower mandrel portion may have an anti-rotation profile 220 defined thereon. Stage cementing tool 200 is shown in a closed or run-in position 222 in FIG. 8 and a set position 224 in FIG. 9. The open or cementing position 226 is shown in FIG. 10 and a fourth or completed position of the stage cementing tool 200 is shown in FIG. 11.

A packer 230 comprising a packer element 232 or a plurality of packer elements 232 is disposed about mandrel 202. Packer assembly 230 comprises a fixed wedge 234 that is stationary on mandrel 202 and a setting wedge 236. Setting wedge 236 is slidable relative to mandrel 202. A setting sleeve 238 may be integrally formed with or connected to a separate setting wedge 236. Packer shoes 240 are disposed at upper and lower ends of packer elements 232. Packer 230 is movable from the unset position shown in 242 to the set position 244 shown in FIG. 9. Once packer 230 is moved to the set position setting wedge 236 will be restrained from moving upwardly. A body lock ring 243 is connected to and will move with setting sleeve 238. Body lock ring 243 is disposed in an annulus 245 defined by and between setting sleeve 238 and mandrel 202. Body lock ring 243 will engage a series of teeth defined on the outer surface 210 of mandrel 202 and will lock setting sleeve 238 and setting wedge 236 in place once the packer 230 is in the set position.

A cementing valve 246 comprises an opening sleeve 248 disposed in mandrel 202. Opening sleeve 248 has upper end 250, lower end 252, an inner surface 254 and an outer surface 256. An opening seat 258 is defined at the upper end 250 of opening sleeve 248. Opening seat 258 may be a separate piece that is connected to opening sleeve 248 or may be integrally formed therewith. A plurality of breakable drive pins 260 are connected to opening sleeve 248 and extend through longitudinal slots 215. Breakable drive pins 260 are likewise connected to setting sleeve 238. Opening sleeve 248 is shown in the closed or run-in position 262 in FIG. 8, a set position 264 in FIG. 9, and an open or cementing position 266 in FIG. 10. Once in the cementing position 266, the opening sleeve 248 does not move downward any further.

An opening plug 268 is displaced into casing 5 once the prior stage cementing is complete. The opening plug 268 will engage opening seat 258 and pressure will be increased to cause the opening sleeve 248 to move downwardly. The opening sleeve will cause setting sleeve 238 to move downwardly. Setting sleeve 238 will move downwardly with opening sleeve 248 to move packer 230 into the set position which is the set position of the stage cementing tool 200. When stage cementing tool 200 is moved to the set position, flow through ports 214 is still blocked by opening sleeve 248. An increase in pressure above opening plug 268 causes drive pins 260 to break and allow opening sleeve 248 to move downwardly relative to setting sleeve 238 and mandrel 202 to the cementing position as shown in FIG. 9. Cement can then be flowed downwardly through central flow passage 212 and communicated to annulus 20 through cement flow ports 214.

A closing sleeve 270 is disposed in mandrel 202 and is detachably connected thereto. Closing sleeve 270 has upper end 272, lower end 274, and defines a closing seat 276 at the upper end 272 thereof. Closing seat 276 may be a separate piece connected to closing sleeve 270 or may be integrally formed therewith. Closing sleeve 270 has outer surface 278 and inner surface 280. The closing sleeve 270 is detachably connected to mandrel 202 with shear pins 282.

Figure 12:
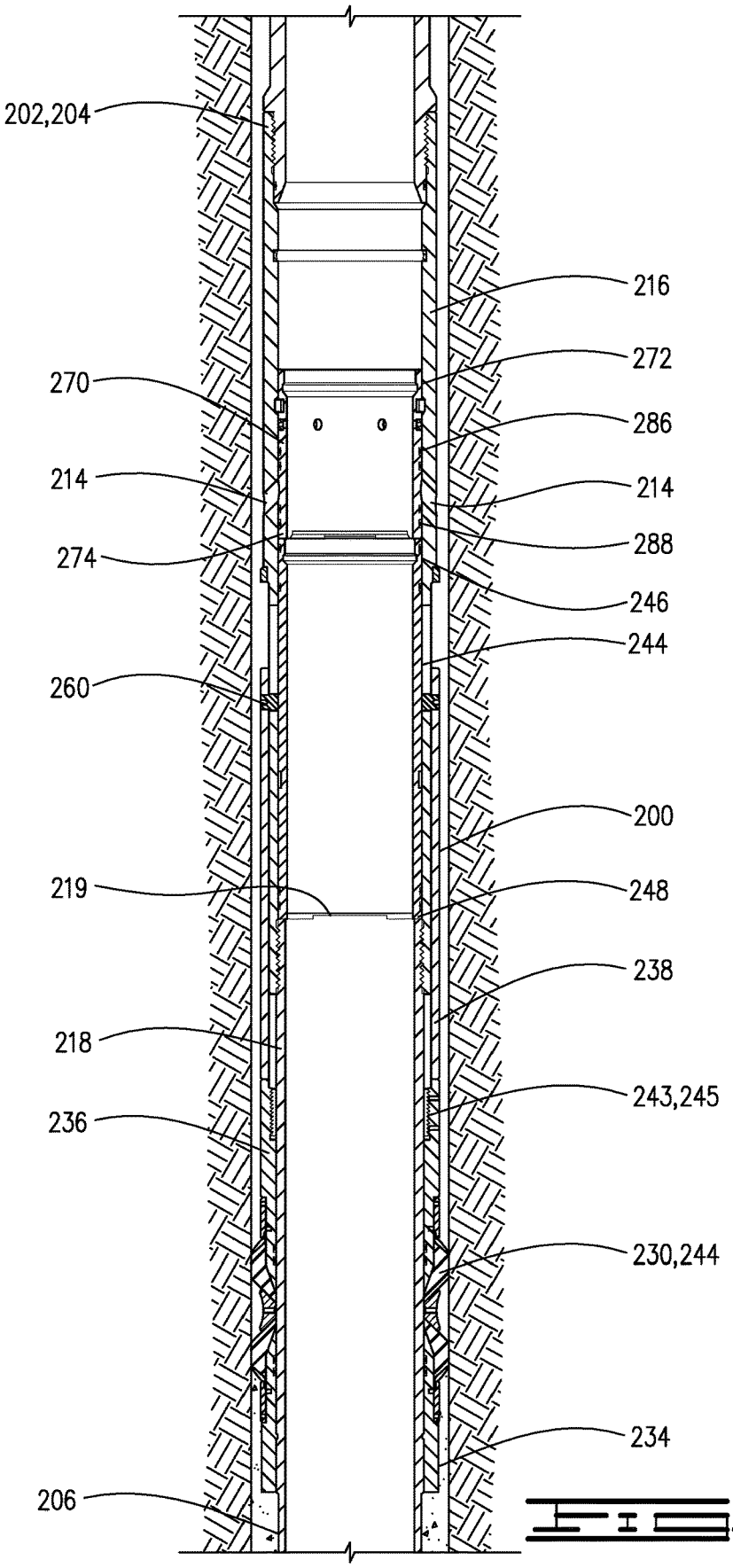
FIG. 12 is a cross section of the cementing tool of FIG. 8 after the plugs have been drilled out.

Once a desired amount of cement has been displaced into casing 10 through cement flow ports 214, closing plug 284 will be displaced into casing 10 at the trailing edge of cement. Closing plug 284 will engage closing seat 276. Pressure will be increased until shear pins 282 are broken and closing sleeve 270 moves from its first position shown in FIG. 8 to its second position shown in FIG. 11, which is the completed position of the stage cementing tool 200. In that position, flow through cement flow ports 214 to annulus 20 is prevented as a result of sealing engagement of closing sleeve 270 with the inner surface 208 of mandrel 202. Closing sleeve 270 may have a plurality of spaced-apart seals 286 above cement flow ports 214 and a plurality of seals 288 below cement flow ports 214 in the completed position which will sealingly engage mandrel 202. If desired, the closing plug and opening plug can be drilled out thereafter to provide for a clean full bore passageway as depicted in FIG. 12.

Stage cementing tool 200 is similar to stage cementing tool 12 in a number of aspects. Stage cementing tool 200 has a mandrel, or tool body that includes upper and lower mandrels connected together as opposed to a mandrel or tool body that is a single tubular like that of stage cementing tool 12. Stage cementing tool 200 has a cementing valve 246 and packer 230 on the mandrel 202, wherein the cementing valve 246 moves to both set the packer 230 and open communication from central flow passage 212 to annulus 20 through central flow ports 214. The packer 230 is set in an intermediate position of the cementing valve 246 between the closed position shown in FIG. 7 and the open position shown in FIG. 9. The stage cementing tool 200 is moved to the completed position by utilizing closing plug 284 to engage and move closing sleeve 270 to cover ports 214 and prevent flow therethrough.

EXAMPLE EMBODIMENTS

Embodiment 1: A stage cementing tool for use in a wellbore comprises a mandrel defining a central flow passage and defining a plurality of fully open cement flow ports in a wall thereof. The stage cementing tool and the wellbore define an annulus therebetween. A packer is disposed about the mandrel and is movable from an unset to a set position. An opening sleeve is disposed in the mandrel and is movable from a closed position in which the opening sleeve covers the cement flow ports to prevent flow therethrough to an open position in which the flow ports are exposed to allow flow therethrough from the central flow passage to the annulus. A setting sleeve is slidably disposed about the mandrel and the setting sleeve is connected to and movable with the opening sleeve. The opening sleeve is operable to move the setting sleeve to set the packer against the wellbore as it moves in the mandrel from the closed to the open position.

Embodiment 2: The stage cementing tool of embodiment 1, the cement flow ports being sealingly captured between the opening sleeve and the setting sleeve in the closed position of the opening sleeve, the packer being moved to the set position by the setting sleeve at an intermediate position of the opening sleeve between the closed and open positions.

Embodiment 3: The stage cementing tool of any of embodiments 1-2, further comprising a plurality of drive pins connected to the opening sleeve and the setting sleeve, the drive pins movable in longitudinal slots defined in the mandrel.

Embodiment 4: The stage cementing tool of any of embodiments 1-3, the opening sleeve being detachably connected to the setting sleeve with drive pins, the drive pins comprising breakable drive pins that break after the packer is in the set position.

Embodiment 5: The stage cementing tool of any of embodiments 1-4, further comprising a closing sleeve detachably connected to the mandrel, the closing sleeve movable in the mandrel to block flow through the cement flow ports after the opening sleeve has moved to the open position and a desired amount of cement has been placed in the annulus.

Embodiment 6: The stage cementing tool of embodiment 5, an upper end of the opening sleeve defining a stop for the closing sleeve.

Embodiment 7: The stage cementing tool of any of embodiments 1-6, further comprising a plug engaged with an opening seat defined on the opening sleeve, the opening sleeve movable in the mandrel upon the application of pressure in the casing above the opening plug.

Embodiment 8: A stage cementing tool positioned in a wellbore, the stage cementing tool and wellbore defining an annulus therebetween comprising a mandrel connected in a casing string, the mandrel defining a central flow passage and a plurality of fully open cement flow ports in a wall thereof; a packer disposed about the mandrel movable from an unset to a set position; and a valve movable from a closed position blocking flow from the central flow passage through the cement flow ports to an open position in which the central flow passage is in communication with the annulus through the cement flow ports, the valve operable to move the packer to the set position as it moves from the open to the closed positions.

Embodiment 9: The stage cementing tool of embodiment 8, the valve comprising an opening sleeve disposed in the mandrel; and a setting sleeve disposed about the mandrel connected to and movable with the opening sleeve, the opening sleeve operable to move the setting sleeve on the mandrel to set the packer prior to moving to the open position.

Embodiment 10: The stage cementing tool of any of embodiments 8-9, further comprising a plurality of breakable drive pins connecting the opening sleeve to the setting sleeve that break after the packer is set, the opening sleeve movable downward relative to the setting sleeve after the packer is set.

Embodiment 11: The stage cementing tool of any of embodiments 8-10, further comprising a closing sleeve detachably connected in the mandrel and movable in the mandrel to block flow through the cement flow ports after a desired amount of cement has been placed in the annulus.

Embodiment 12: The stage cementing tool of any of embodiments 8-11 further comprising an opening plug displaced into the mandrel to engage the opening sleeve and move the packer to the set position upon the application of pressure in the casing, the opening sleeve disconnecting from the setting sleeve upon the continued application of pressure to move the opening sleeve to the open position.

Embodiment 13: The stage cementing tool of any of embodiments 8-12, the mandrel comprising a single tubular.

Embodiment 14: The stage cementing tool of any of embodiments 8-12, the mandrel comprising a plurality of connected tubulars the upper end of one of the tubulars coacting with a lower end of the opening sleeve in the cementing position to prevent rotation of the opening sleeve during drill-out after cementing.

Embodiment 15: A stage cementing tool for use in a wellbore comprising a mandrel defining a central flow passage connected in a casing string lowered into the wellbore, the casing string and wellbore defining an annulus therebetween; a setting sleeve movably disposed on the mandrel; an opening sleeve movably disposed in the mandrel in a closed position to block flow from the central flow passage to the annulus through a plurality of cement flow ports defined in a wall of the mandrel; a packer disposed about the mandrel and movable from an unset to a set position; a plurality of drive pins detachably connecting the opening sleeve to the setting sleeve, the drive pins slidable in slots defined in the wall of the mandrel; and an opening plug engaging the opening sleeve, the opening sleeve moving downwardly to move the packer to the set position as pressure above the opening plug is increased, the opening sleeve being detached from the setting sleeve upon the application of additional pressure and movable downwardly relative to the setting sleeve to an open position in which the central flow passage is communicated with the annulus through the cement flow ports after the packer is moved to the set position.

Embodiment 16: The stage cementing tool of embodiment 15, the central flow ports sealingly trapped between the opening sleeve and the setting sleeve in the closed position of the opening sleeve.

Embodiment 17: The stage cementing tool of any of embodiments 15-16 further comprising a closing sleeve detachably connected in the mandrel, the closing sleeve having a seat for receiving a closing plug and movable in the mandrel to block flow through the cement flow ports after a desired amount of cement has been flowed into the annulus therethrough.

Embodiment 18: The stage cementing tool of any of embodiments 15-17, the mandrel comprising an upper mandrel and a lower mandrel connected to the upper mandrel, the lower mandrel having an upper end that coacts with a lower end of the opening sleeve to prevent rotation of the opening sleeve during drill-out.

Embodiment 19: The stage cementing tool of any of claims 15-17, the mandrel comprising a single tubular with an outer surface defining at least first and second outer diameters, the setting sleeve and the first diameter defining an annular space therebetween, the stage cementing tool further comprising a body lock ring in the annular space.

Embodiment 20: The stage cementing tool of any of embodiments 15-19, the plurality of drive pins comprising breakable drive pins that break after the packer is set.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A stage cementing tool for use in a wellbore comprising:

a mandrel defining a central flow passage and defining a plurality of fully open cement flow ports in a wall thereof, the stage cementing tool and the wellbore defining an annulus therebetween;

a packer disposed about the mandrel movable from an unset to a set position;

an opening sleeve disposed in the mandrel and movable from a closed position in which the opening sleeve covers the cement flow ports to prevent flow therethrough to an open position in which the flow ports are exposed to allow flow therethrough from the central flow passage to the annulus;

a setting sleeve slidably disposed about the mandrel, the setting sleeve connected to and movable with the opening sleeve; and a plurality of drive pins connected to the opening sleeve and the setting sleeve, the drive pins movable in longitudinal slots defined in the mandrel, the opening sleeve operable to move the setting sleeve to set the packer against the wellbore as it moves in the mandrel from the closed to the open position.

2. The stage cementing tool of claim 1, the cement flow ports being sealingly captured between the opening sleeve and the setting sleeve in the closed position of the opening sleeve, the packer being moved to the set position by the setting sleeve at an intermediate position of the opening sleeve between the closed and open positions.

3. The stage cementing tool of claim 1, the opening sleeve being detachably connected to the setting sleeve with the drive pins, the drive pins comprising breakable drive pins that break after the packer is in the set position.

4. The stage cementing tool of claim 1, further comprising a closing sleeve detachably connected to the mandrel, the closing sleeve movable in the mandrel to block flow through the cement flow ports after the opening sleeve has moved to the open position and a desired amount of cement has been placed in the annulus.

5. The stage cementing tool of claim 4, an upper end of the opening sleeve defining a stop for the closing sleeve.

6. The stage cementing tool of claim 1, further comprising an opening plug engaged with an opening seat defined on the opening sleeve, the opening sleeve movable in the mandrel upon the application of pressure in the casing above the opening plug.

7. A stage cementing tool positioned in a wellbore, the stage cementing tool and wellbore defining an annulus therebetween comprising:

a mandrel connected in a casing string, the mandrel defining a central flow passage and a plurality of fully open cement flow ports in a wall thereof;

a packer disposed about the mandrel movable from an unset to a set position; and a valve movable from a closed position blocking flow from the central flow passage through the cement flow ports to an open position in which the central flow passage is in communication with the annulus through the cement flow ports, the valve operable to move the packer to the set position as it moves from the open to the closed positions, the mandrel comprising a plurality of connected tubulars, the upper end of one of the tubulars engaged with a lower end of the valve in the cementing position to prevent rotation of the valve during drill-out after cementing.

8. The stage cementing tool of claim 7, the valve comprising:

an opening sleeve disposed in the mandrel; and a setting sleeve disposed about the mandrel connected to and movable with the opening sleeve, the opening sleeve operable to move the setting sleeve on the mandrel to set the packer prior to moving to the open position.

9. The stage cementing tool of claim 8, further comprising a plurality of breakable drive pins connecting the opening sleeve to the setting sleeve that break after the packer is set, the opening sleeve movable downward relative to the setting sleeve after the packer is set.

10. The stage cementing tool of claim 7, further comprising a closing sleeve detachably connected in the mandrel and movable in the mandrel to block flow through the cement flow ports after a desired amount of cement has been placed in the annulus.

11. The stage cementing tool of claim 7 further comprising an opening plug displaced into the mandrel to engage the opening sleeve and move the packer to the set position upon the application of pressure in the casing, the opening sleeve disconnecting from the setting sleeve upon the continued application of pressure to move the opening sleeve to the open position.

12. The stage cementing tool of claim 7, the mandrel comprising a single tubular.

13. A stage cementing tool for use in a wellbore comprising:

a mandrel defining a central flow passage connected in a casing string lowered into the wellbore, the casing string and wellbore defining an annulus therebetween;

a setting sleeve movably disposed on the mandrel;

an opening sleeve movably disposed in the mandrel in a closed position to block flow from the central flow passage to the annulus through a plurality of cement flow ports defined in a wall of the mandrel;

a packer disposed about the mandrel and movable from an unset to a set position;

a plurality of drive pins detachably connecting the opening sleeve to the setting sleeve, the drive pins slidable in slots defined in the wall of the mandrel; and an opening plug engaging the opening sleeve, the opening sleeve moving downwardly to move the packer to the set position as pressure above the opening plug is increased, the opening sleeve being detached from the setting sleeve upon the application of additional pressure and movable downwardly relative to the setting sleeve and the mandrel to an open position in which the central flow passage is communicated with the annulus through the cement flow ports after the packer is moved to the set position.

14. The stage cementing tool of claim 13, the central flow ports sealingly trapped between the opening sleeve and the setting sleeve in the closed position of the opening sleeve.

15. The stage cementing tool of claim 13 further comprising a closing sleeve detachably connected in the mandrel, the closing sleeve having a seat for receiving a closing plug and movable in the mandrel to block flow through the cement flow ports after a desired amount of cement has been flowed into the annulus therethrough.

16. The stage cementing tool of claim 13, the mandrel comprising:

an upper mandrel; and a lower mandrel connected to the upper mandrel, the lower mandrel having an upper end that coacts with a lower end of the opening sleeve to prevent rotation of the opening sleeve during drill-out.

17. The stage cementing tool of claim 13, the mandrel comprising a single tubular with an outer surface defining at least first and second outer diameters, the setting sleeve and the first diameter defining an annular space therebetween, the stage cementing tool further comprising a body lock ring in the annular space.

18. The stage cementing tool of claim 13, the plurality of drive pins comprising breakable drive pins that break after the packer is set.

* * * * *